US011732901B2

(12) United States Patent
Kim et al.

(10) Patent No.: US 11,732,901 B2
(45) Date of Patent: Aug. 22, 2023

(54) VENTILATION APPARATUS AND VENTILATION SYSTEM INCLUDING THE SAME

(71) Applicant: SAMSUNG ELECTRONICS CO., LTD., Suwon-si (KR)

(72) Inventors: Jaejun Kim, Suwon-si (KR); Gerhardt Kellermann, Munich (DE); Ana Relvão, Munich (DE); Gisung Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 303 days.

(21) Appl. No.: 17/143,600

(22) Filed: Jan. 7, 2021

(65) Prior Publication Data

US 2021/0215350 A1 Jul. 15, 2021

(30) Foreign Application Priority Data

Jan. 10, 2020 (KR) ..... 10-2020-0003815

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2042; F24C 15/2035; F24C 15/2078; F24C 15/2092
(Continued)

(56) References Cited

U.S. PATENT DOCUMENTS 4,446,849 A * 5/1984 McFarland ..... F24C 15/2092 126/303
4,766,880 A * 8/1988 von Blanquet ..... F24C 15/2042 126/299 D (Continued)

FOREIGN PATENT DOCUMENTS

CN 110160102 A 8/2019
JP 07-208797 A 8/1995

(Continued)

OTHER PUBLICATIONS

PCT International Search Report dated May 3, 2021 for International Application No. PCT/KR2021/000080.

*Primary Examiner* — Ko-Wei Lin
(74) *Attorney, Agent, or Firm* — Staas & Halsey LLP

(57) ABSTRACT

Disclosed is a ventilation apparatus including an exhaust pipe of an induction hood in which a position change of piping in a discharge direction is freely performed. The ventilation apparatus, which includes a first pipe connected to a suction port through which contaminated air is sucked, a second pipe configured to guide the contaminated air and include a first connection portion connected to the first pipe and a second connection portion extending from the first connection portion, the second pipe being detachably coupled to the first pipe so that the position of the second connection portion is able to be changed, and a third pipe connected to the second pipe and include a discharge port through which the contaminated air is discharged, the third pipe being configured to be rotatable with respect to the second pipe so that the position of the discharge port is able to be changed.

17 Claims, 22 Drawing Sheets

(58) Field of Classification Search
USPC ..... 126/299 r, 300, 301, 299 d, 299 f
See application file for complete search history.

(56) References Cited

U.S. PATENT DOCUMENTS

| | | | | | |
|---|---|---|---|---|---|
| 5,062,410 | A * | 11/1991 | Sarnosky | F24C 15/2092 | 126/299 R |
| 5,884,619 | A * | 3/1999 | Terry | F24C 15/2042 | 126/299 D |
| 6,732,730 | B1 * | 5/2004 | Lin | F24C 15/20 | 126/299 R |
| 6,837,152 | B1 * | 1/2005 | Chiang | A47J 36/38 | 99/422 |
| 6,877,506 | B2 * | 4/2005 | Shekarri | F24C 15/2085 | 108/50.13 |
| 8,851,064 | B2 * | 10/2014 | Bruckbauer | F24C 15/2071 | 126/299 D |
| 9,175,861 | B2 * | 11/2015 | Sosso | B23P 19/00 | |
| 9,612,022 | B2 * | 4/2017 | Chiang | F24C 15/2057 | |
| 9,869,474 | B2 * | 1/2018 | McEvoy | B01D 46/46 | |
| 9,874,356 | B2 * | 1/2018 | Jeong | F24C 15/2028 | |
| 9,897,329 | B2 * | 2/2018 | Sosso | F24C 15/2042 | |
| 2006/0150965 | A1 * | 7/2006 | Kim | F24C 15/2042 | 126/299 D |
| 2007/0023420 | A1 | 2/2007 | Gagas | | |
| 2007/0062513 | A1 * | 3/2007 | Gagas | F24C 15/2042 | 126/299 D |
| 2008/0185376 | A1 | 8/2008 | Gagas et al. | | |
| 2010/0163549 | A1 * | 7/2010 | Gagas | F24C 15/2042 | 219/622 |
| 2015/0144616 | A1 | 5/2015 | Gagas et al. | | |
| 2018/0207312 | A1 * | 7/2018 | Chiang | B01D 46/4245 | |
| 2019/0186758 | A1 * | 6/2019 | Heppi | F24C 15/2042 | |
| 2019/0277511 | A1 * | 9/2019 | Flowers | F24C 15/2042 | |

FOREIGN PATENT DOCUMENTS

| | | | | |
|---|---|---|---|---|
| JP | 07208797 | A | * | 8/1995 |
| JP | 2891694 | B1 | | 5/1999 |
| KR | 10-2006-0087209 | A | | 8/2006 |
| KR | 10-2013-0054722 | A | | 5/2013 |

* cited by examiner

VENTILATION APPARATUS AND VENTILATION SYSTEM INCLUDING THE SAME

CROSS-REFERENCE TO RELATED APPLICATION(S)

This application is based on and claims priority under 35 U.S.C. § 119 to Korean Patent Application No. 10-2020-0003815, filed on Jan. 10, 2020, in the Korean Intellectual Property Office, the disclosure of which is incorporated by reference herein in its entirety.

BACKGROUND

1. Field

The disclosure relates to a ventilation apparatus capable of easily discharge contaminated air and smoke generated when food is cooked, and more particularly, to a ventilation apparatus including an exhaust pipe coupling structure of an induction hood in which a position change of piping in a discharge direction is freely performed and a ventilation system including the same.

2. Description of the Related Art

In general, a hood that sucks contaminated air or smoke generated during cooking and exhausts the air or smoke to the outside is disposed above a cooking apparatus such as a gas range and an induction cooker.

Recently, an Irish-style kitchen that is placed away from the wall is in the spotlight.

When a cooking apparatus is installed in an Irish-style kitchen, in terms of space utilization and design, a hood (ventilation apparatus) is not installed on a ceiling, and a downdraft hood in which a hood is installed in the Irish-style kitchen itself is applied.

When the downdraft hood is installed, space utilization is low due to a space occupied by a duct for discharging the sucked air or smoke, and installation of a pipe is required.

A piping structure of such a hood, which is mostly a fixed type, is required to change the direction of piping through a link structure or to correspond to the location, the direction, and the like of the piping by using separate accessory parts.

SUMMARY

In accordance with an aspect of the disclosure, a ventilation apparatus, which is configured to suck contaminated air generated during cooking of food, includes a first pipe connected to a suction port through which the contaminated air is sucked, a second pipe configured to guide the contaminated air and including a first connection portion connected to the first pipe and an extension portion (second connection portion) extending from the first connection portion, the second pipe being detachably coupled to the first pipe so that the position of the extension portion is able to be changed, and a third pipe connected to the second pipe and including a discharge port through which the contaminated air is discharged, the third pipe being configured to be rotatable with respect to the second pipe so that the position of the discharge port is able to be changed.

The third pipe may be rotatably coupled to the extension portion (second connection portion) of the second pipe.

The ventilation apparatus may further include a discharge guide pipe connected to the third pipe to discharge the contaminated air.

The second pipe may be connected to the first pipe and configured to change a flow direction of the contaminated air by 180 degrees.

The second pipe may be positioned on one of the left and right sides of the first pipe.

The second pipe may include a connection member configured to detachably couple the first pipe and the second pipe.

The third pipe may be configured such that the discharge guide pipe is coupled or separated.

The ventilation apparatus may further include a suction fan configured to generate a suction force so that the contaminated air is sucked into the suction part.

The suction fan may be disposed in at least one of the second pipe and the third pipe.

The third pipe may be configured such that air introduced in an axial direction of the suction fan is discharged in the horizontal direction of the discharge port.

The discharge guide pipe may include a horizontal guide pipe, a vertical guide pipe, and at least one of a bent pipe bent from a horizontal direction to a vertical direction, a bent pipe bent from the vertical direction to the horizontal direction, and an elbow pipe having an elbow shape.

The ventilation apparatus may further include at least one filter provided inside the first pipe and configured to purify the contaminated air.

In accordance with another aspect of the disclosure, a ventilation system includes a main body, a heating device provided on an upper surface of the main body and configured to cook food by heating the food, and a ventilation apparatus provided at an edge of the upper surface of the main body and configured to absorb contaminated air generated during cooking of the food, wherein the ventilation apparatus includes a first pipe connected to a suction port through which the contaminated air is sucked, at least one filter provided inside the first pipe and configured to purify the contaminated air, a second pipe including a first connection portion connected to the first pipe to guide the contaminated air and an extension portion (second connection portion) extending from the first connection portion, the second pipe being detachably coupled to the first pipe so that the position of the extension portion (second connection portion) is able to be changed, and a third pipe connected to the second connection portion of the second pipe and including a discharge port through which the contaminated air is discharged, the third pipe being configured to be rotatable with respect to the second pipe so that the position of the discharge port is able to be changed.

The ventilation system may further include a discharge guide pipe connected to the third pipe to discharge the contaminated air.

The discharge guide pipe may include a horizontal guide pipe, a vertical guide pipe, and at least one of a bent pipe bent from a horizontal direction to a vertical direction, a bent pipe bent from the vertical direction to the horizontal direction, and an elbow pipe having an elbow shape.

The third pipe may be configured such that the discharge guide pipe is coupled or separated.

The ventilation system may further include a suction fan configured to generate a suction force so that the contaminated air is sucked into the suction part.

The suction fan may be disposed in at least one of the second pipe and the third pipe.

The second pipe may include a connection member configured to detachably couple the first pipe and the second pipe.

The at least one filter may include a grease filter configured to remove oil contained in the contaminated air.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
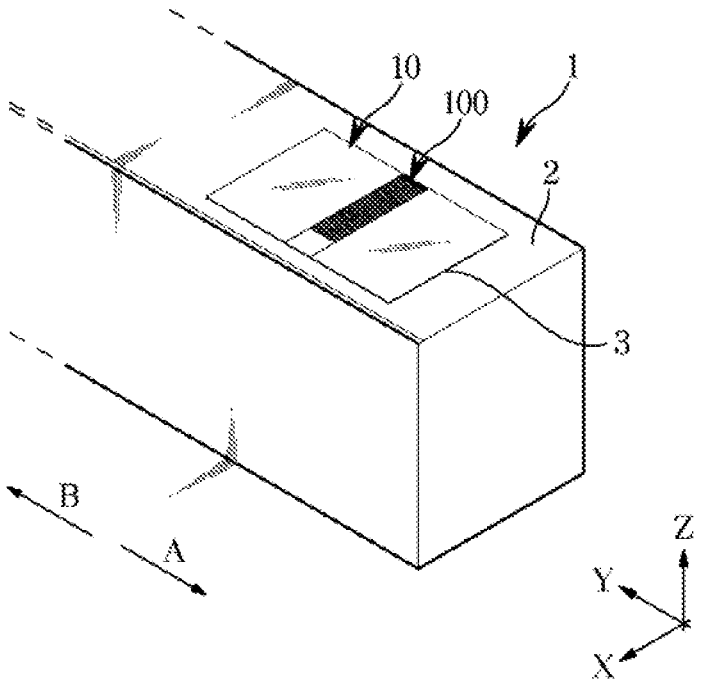
FIG. 1 is a perspective view of a cooking apparatus equipped with a ventilation apparatus according to an embodiment of the disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the disclosure will be described in detail with reference to the accompanying drawings.

It is an aspect of the disclosure to provide a ventilation apparatus including an exhaust pipe coupling structure of an induction hood in which a position change of piping in a discharge direction is freely performed and a ventilation system including the same.

It is another aspect of the disclosure to provide a ventilation apparatus having a compact piping structure and a ventilation system including the same.

It is another aspect of the disclosure to provide a ventilation apparatus having a piping structure capable of reducing installation time and improving space efficiency and a ventilation system including the same.

Figure 2:
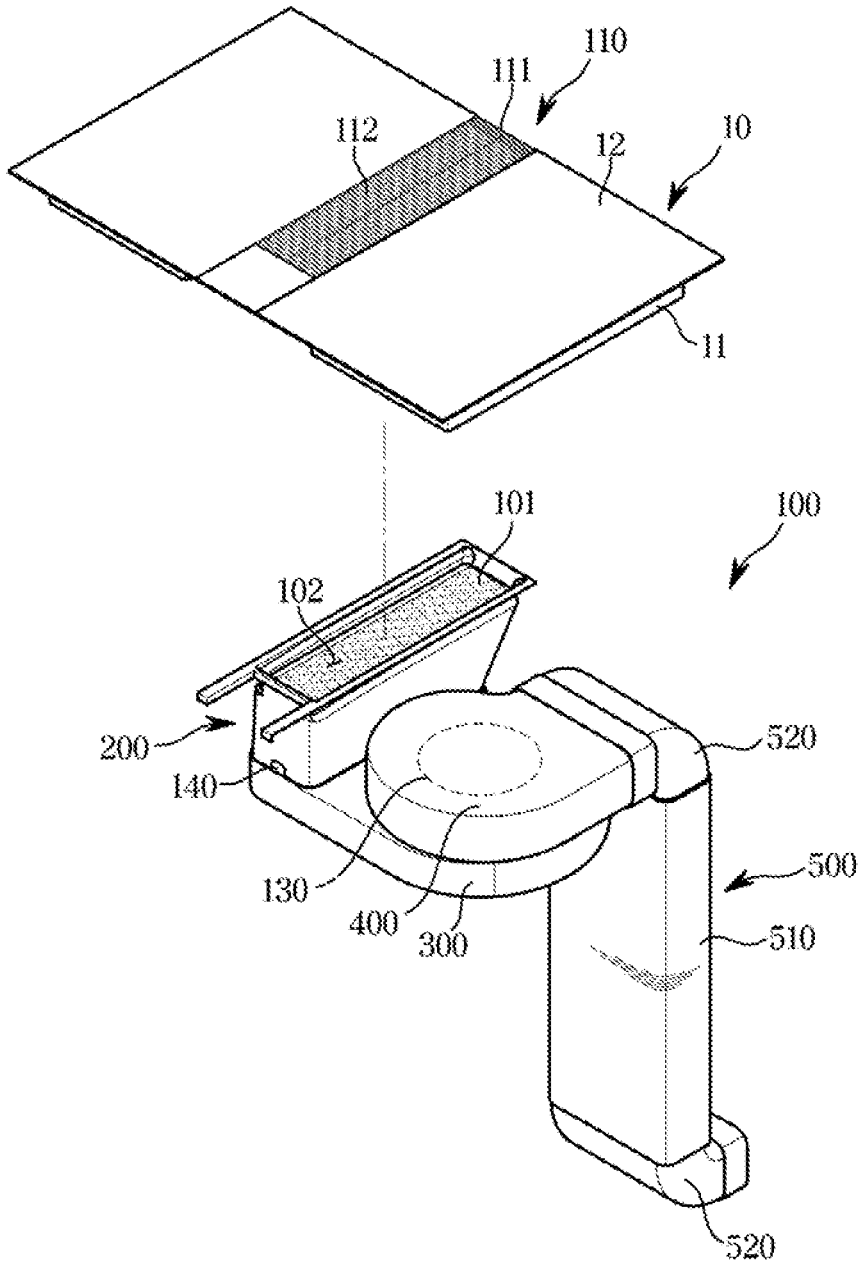
FIG. 2 is a partially exploded perspective view of the cooking apparatus equipped with the ventilation apparatus according to an embodiment of the disclosure.
Figure 3:
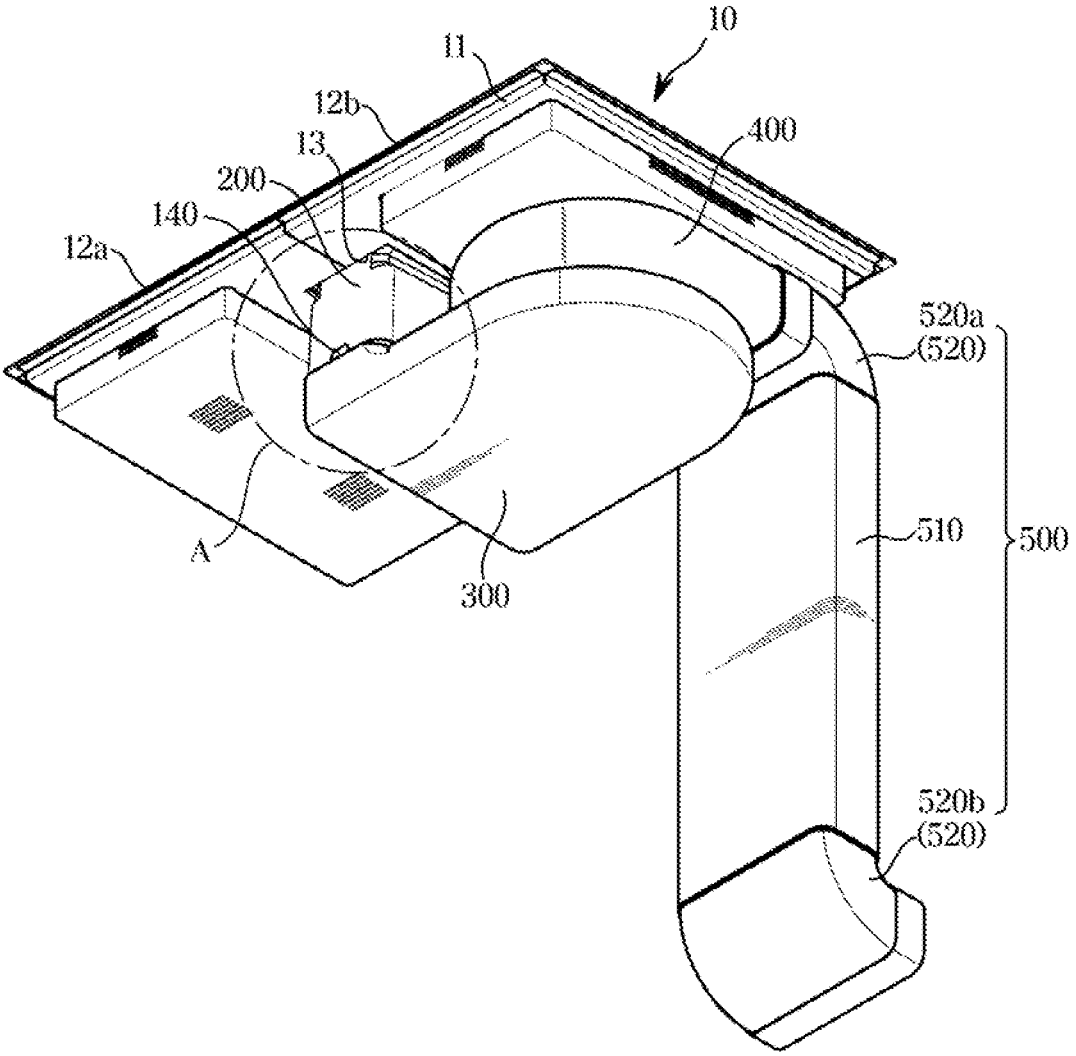
FIG. 3 is a bottom view of the ventilation apparatus according to an embodiment of the disclosure.
Figure 4:
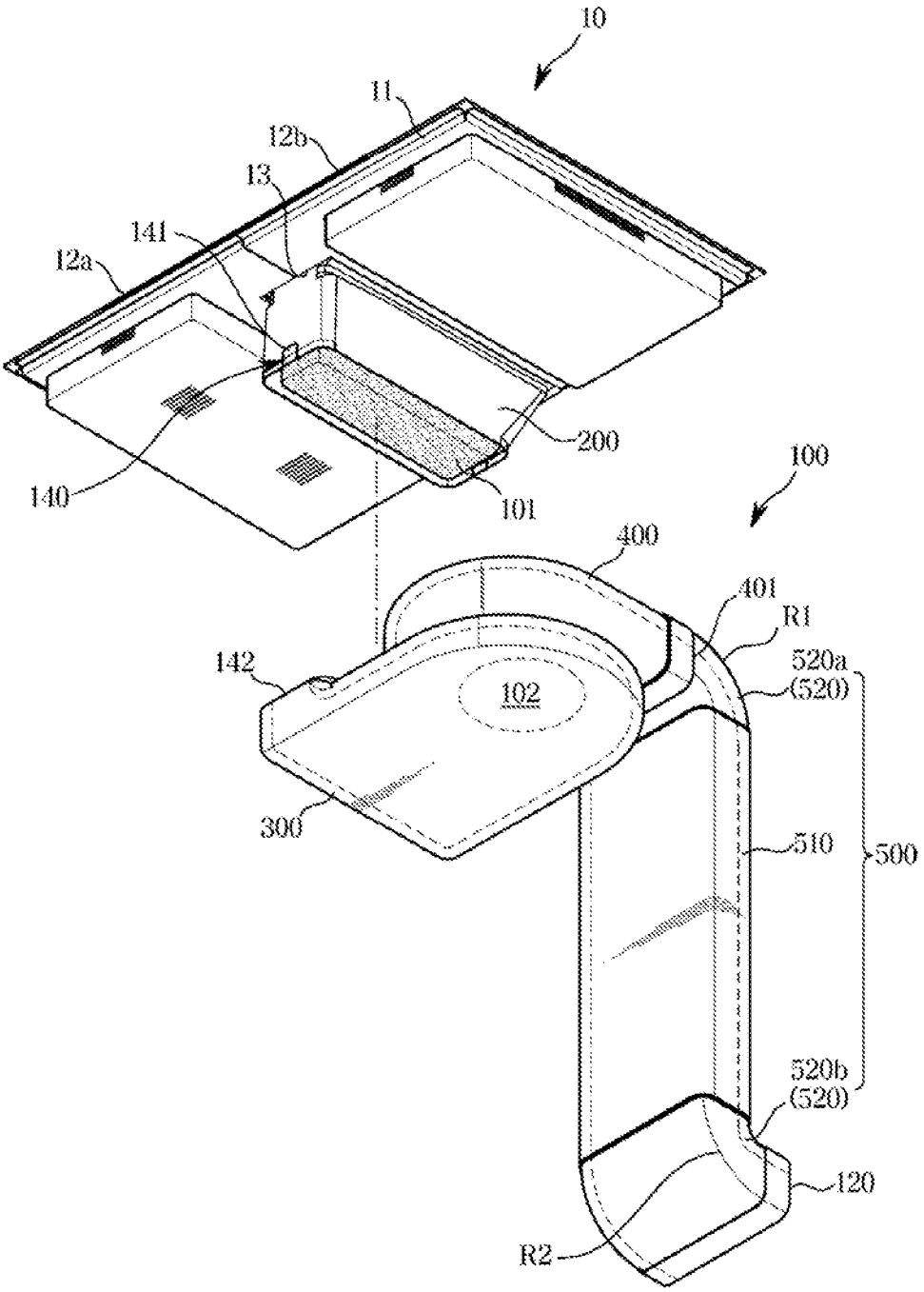
FIG. 4 illustrates a state in which a first pipe and a second pipe in the ventilation apparatus according to an embodiment of the disclosure are separated.

FIG. 1 is a perspective view of a cooking apparatus equipped with a ventilation apparatus according to an embodiment of the disclosure, FIG. 2 is a partially exploded perspective view of the cooking apparatus equipped with the ventilation apparatus according to an embodiment of the disclosure, FIG. 3 is a bottom view of the ventilation apparatus according to an embodiment of the disclosure, and FIG. 4 illustrates a state in which a first pipe and a second pipe in the ventilation apparatus according to an embodiment of the disclosure are separated.

As illustrated in FIGS. 1 to 4, a ventilation system 1 includes a cooking apparatus 10 installed inside a furniture 2 in a kitchen space such as a sink to heat and cook food, and a ventilation apparatus 100 configured to absorb contaminated air generated by the cooking apparatus 10.

The cooking apparatus 10 may be installed in an installation part 3 formed by opening on an upper surface of the furniture 2. The cooking apparatus 10 may include a heating device 12 configured to directly heat food. The heating device 12 heats food itself or a container containing the food by generating high-temperature heat.

The heating device 12 may include a main body 11 having a substantially rectangular parallelepiped shape, and heating parts 12*a* and 12*b* formed in a planar shape on an upper surface of the main body 11. The heating parts 12*a* and 12*b* may include the first heating part 12*a* and the second heating part 12*b*. The first heating part 12*a* and the second heating part 12*b* may be disposed symmetrically to the left and right. The present embodiment illustrates that the heating device (hereinafter referred to as an induction range) is an induction range that has an upper surface formed in a planar shape and is driven by electricity. However, the disclosure may include cooking apparatuses that cook food using electricity, gas, and the like in addition to the induction range.

The main body 11 may include the first heating part 12*a* and the second heating part 12*b* disposed in a left-right direction Y of the heating device 12. The first heating part 12*a* may be disposed on one side of the main body 11 in the left-right direction Y, and the second heating part 12*b* may be disposed on the other side of the main body 11 in the left-right direction Y. A suction part 110 of the ventilation apparatus 100, which will be described later, may be disposed between the first heating part 12*a* and the second heating part 12*b*. The main body 11 may be provided with a ventilation apparatus installation part 13 to install the ventilation apparatus 100. The ventilation apparatus installation part 13 may be formed at the center of a lower surface of the main body 11.

A display 11*a* to display a state or operation of the heating device 12 may be provided on the upper surface of the main body 11. The display 11*a* may be disposed at the center of the upper surface of the main body 11.

The induction range 12 is a heating device for cooking adopting an induction heating method for replacing a gas range, and uses an induced current generated by a magnetic field as a heat source. When a container, which is made of metal whose bottom surface that may be attached to a magnet, is placed on a heater, eddy current is generated on the metal bottom surface of the container by electromagnetic induction so that the container is heated by Joule heat.

Because of a principle of the induction heating method, the induction range 12 does not heat the ambient air and does not generate convection and radiant heat, so that the temperature of the ambient air hardly rises during cooking. However, convection and radiant heat may be transferred to the surroundings by the heated container and the food being cooked, and the ambient temperature may rise. The food in the container being cooked is sufficiently heated through the induction range 12 to reach the boiling point, so that when water is used, water vapor is generated, and when cooking oil is used, oil vapor is generated. The ventilation apparatus 100 may be provided to discharge water vapor or air containing oil vapor to the outside.

The ventilation apparatus 100 may be disposed below the induction range 12. The ventilation apparatus 100 may include the suction part 110 to suck contaminated air. The suction part 110 may include a suction port 111. The suction port 111 of the ventilation apparatus 100 is provided on the upper surface of the main body 11 and may be disposed at a center between the first heating part 12*a* and the second heating part 12*b*.

The ventilation apparatus 100 is configured to absorb contaminated air, smoke, odor, and the like generated while the induction range 12 cooks food and discharge them to the outside. The ventilation apparatus 100 may be configured to suck and filter out contaminated air generated while food is cooked in the first heating part 12*a* and the second heating part 12*b* and discharge filtered air to the outside. The ventilation apparatus 100 may include the suction part 110 to suck contaminated air, a first pipe 200 connected to the suction part 110, a second pipe 300 detachably connected to the first pipe 200, a third pipe 400 rotatably connected to the second pipe 300, and a discharge guide pipe 500 to connect the third pipe 400 and a discharge hole O.

The discharge hole O may be formed on at least one of the furniture 2 on which the ventilation apparatus 100 is installed and a wall w. The discharge hole O may be formed at various positions depending on the shape and size of the furniture 2 or the structure of a building.

The ventilation apparatus 100 may include a flow passage 102 through which contaminated air flows. The flow passage 102 may be formed between the suction port 111 and one end of the discharge guide pipe 500. In this case, the one end of the discharge guide pipe 500 may be connected to the discharge hole O.

The suction port 111 of the ventilation apparatus 100 may be disposed at the center between the first heating part 12*a* and the second heating part 12*b*. A suction grill 112 may be provided in the suction port 111. The suction grill 112 formed in the suction port 111 may be disposed at the center of the upper surface of the body 11. The embodiment of the disclosure illustrates that the suction part 110 is disposed at the center between the first heating part 12*a* and the second heating part 12*b*, but the disclosure is not limited thereto. For example, the suction port 111 may be disposed to be biased to one side of the first heating part 12*a* in a first direction A. Also, the suction part 110 may be disposed to be biased to one side of the second heating part 12*b* in a second direction B. The ventilation apparatus 100 may include the first pipe 200 in communication with the suction port 111. The first pipe 200 may be configured to form the flow passage 102 therein. The flow passage 102 may be formed between the suction port 111 through which air is suctioned and the discharge hole O through which the suctioned air is discharged.

The first pipe 200 may be installed in the ventilation apparatus installation part 13 of the main body 11. An embodiment of the disclosure illustrates that the suction port 111 is provided and installed separately from the first pipe 200, but the disclosure is not limited thereto. For example, the suction port 111 and the suction grill 112 may be integrally formed in the first pipe 200 and installed in the main body 11 of the cooking apparatus 10. A plurality of holes is formed in the suction grill 112.

An upper end of the first pipe 200 may be formed in a shape and size corresponding to the suction grill 112 to be connected to the suction grill 112. At least one filter 101 may be provided inside the first pipe 200 to filter out contaminated air.

The at least one filter 101 may include a grease filter. The grease filter is a filter that collects oil contained in contaminated air and makes the oil droplets. As oil component is removed from the contaminated air, the contaminated air may be purified, deformation of a duct forming an air flow passage may be prevented, and fire caused by high temperature oil may be prevented. The contaminated air may pass through the grease filter to remove the oil component from the contaminated air.

The at least one filter 101 may further include a filter (not shown) for removing volatile organic compounds (VOCs).

The volatile organic compounds refer to hydrocarbon compounds that are volatilized in the atmosphere and generate odor or ozone. In particular, the volatile organic compounds themselves are directly harmful to the environment and human body and may also participate in photochemical reactions in the atmosphere to generate secondary pollutants such as photochemical oxides.

These volatile organic compounds, as one of the carcinogens, need to be essentially removed in order for contaminated air to be purified and discharged into the room. Thus, contaminants may be removed from contaminated air by the at least one filter 101 to purify the contaminated air.

Air from which contaminants have been removed may be in a suitable state for being discharged indoors or outdoors.

The air from which contaminants have been removed by the at least one filter 101 is delivered to the third pipe 400 through the second pipe 300 connected to the first pipe 200.

The ventilation apparatus 100 may include a suction fan 130 configured to generate a suction force to suck contaminated air into the flow passage 102 through the suction part 110. The suction fan 130 may be disposed in at least one of the second pipe 300 and the third pipe 400. The suction fan 130 may be disposed in the second pipe 300. The suction fan 130 may be disposed in the third pipe 400.

The suction fan 130 may include a sirocco fan (not shown). The sirocco fan, which is one of centrifugal blowers, is formed by protruding a plurality of blades having a short length and a wide width in a radial direction. The Sirocco fan is mainly used as a ventilation fan because of its low noise.

The contaminated air may be introduced into the flow passage 102 by the suction fan 130 and moved to the third pipe 400 after contaminants are removed by the at least one filter 101.

The second pipe 300 may be detachably coupled to the first pipe 200. The third pipe 400 may be provided with a discharge port 401 through which air sucked and moved through the suction part 110 by the suction fan 130 is discharged.

The third pipe 400 may be rotatably connected to the second pipe 300. The third pipe 400 may be disposed to be connected to an upper side of the second pipe 300. The third pipe 400 may be disposed to extend in the first direction A from the first pipe 200 or may be disposed to extend in the second direction B from the first pipe 200. The third pipe 400 is configured such that the discharge guide pipe 500 may be detachably coupled thereto. The discharge guide pipe 500 may be connected to or separated from the discharge port 401 of the third pipe 400.

The discharge guide pipe 500 is configured to be in communication with an end of the third pipe 400. The discharge guide pipe 500 may be connected to the discharge port 401 of the third pipe 400. The discharge guide pipe 500 may be detachably coupled to the third pipe 400. The discharge guide pipe 500 may include a vertical guide pipe 510, a horizontal guide pipe 530, and at least one of a bent pipe 520 that is bent in a vertical direction from a horizontal direction, the bent pipe 520 that is bent in the horizontal direction from the vertical direction, and an elbow pipe 520A having an elbow shape in the horizontal direction.

Figure 5:
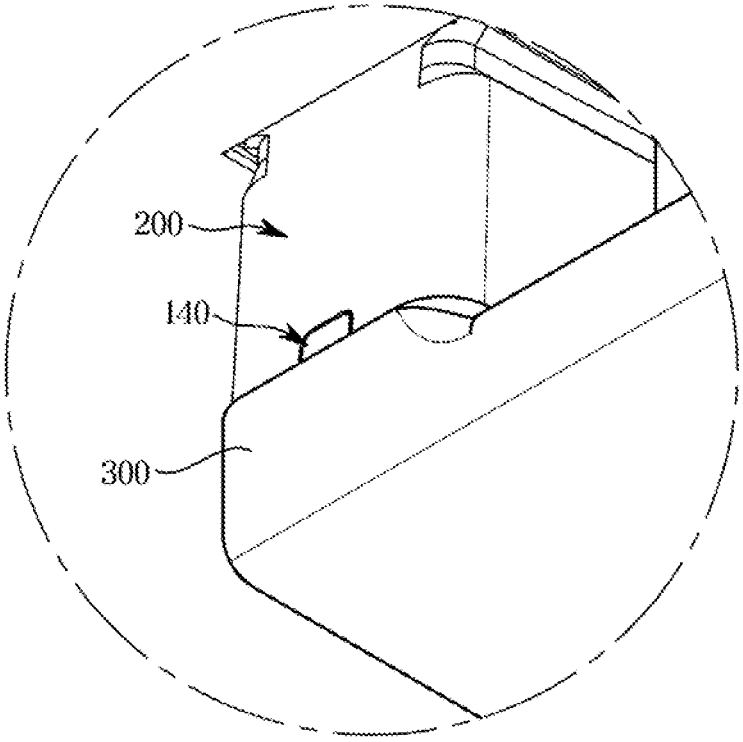
FIG. 5 is an enlarged view of an area A in FIG. 3, illustrating a state in which the first pipe and the second pipe in the ventilation apparatus according to an embodiment of the disclosure are coupled to each other.
Figure 6:
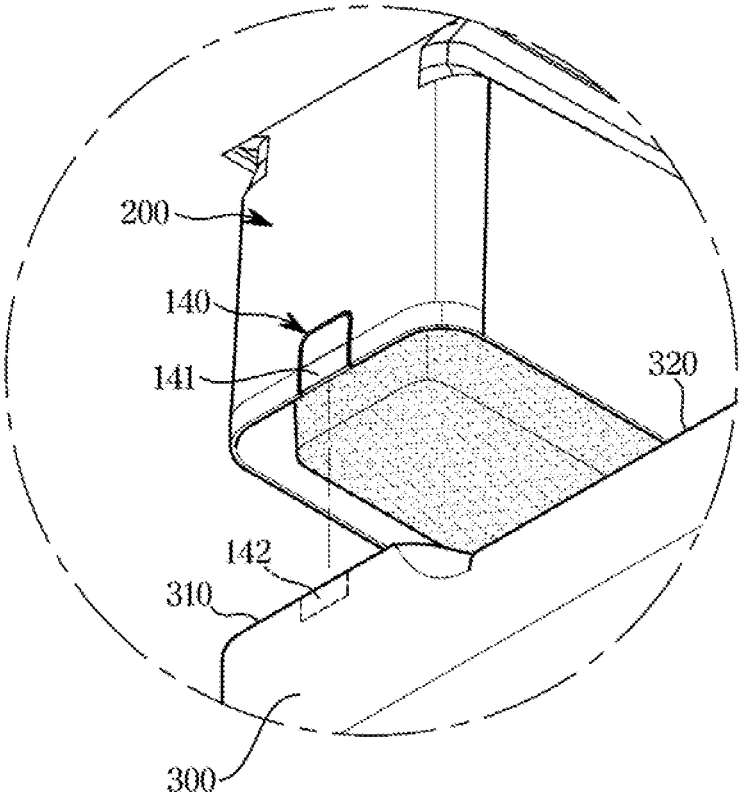
FIGS. 6 to 8 illustrate operations of changing a direction of the second pipe with respect to the first pipe in the ventilation apparatus according to an embodiment of the disclosure.
Figure 7:
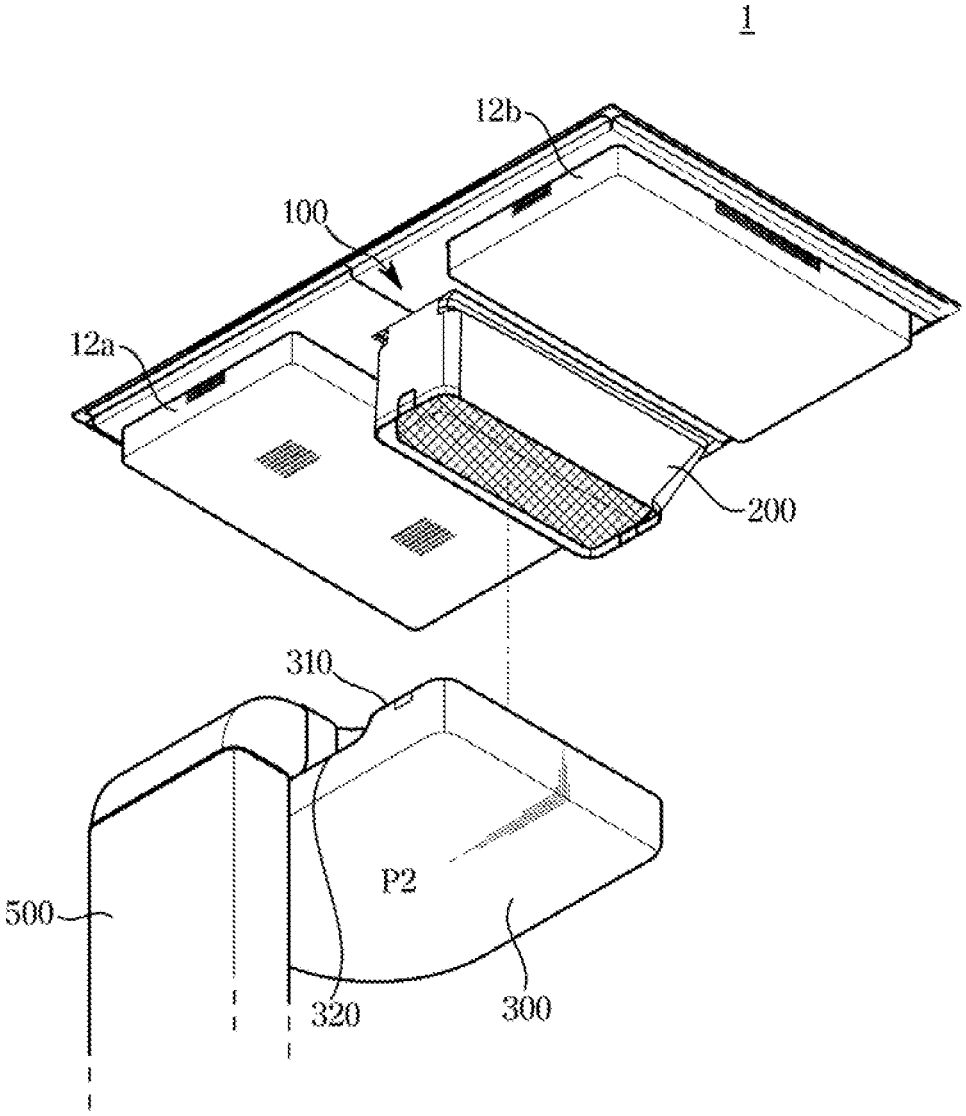
Figure 8:
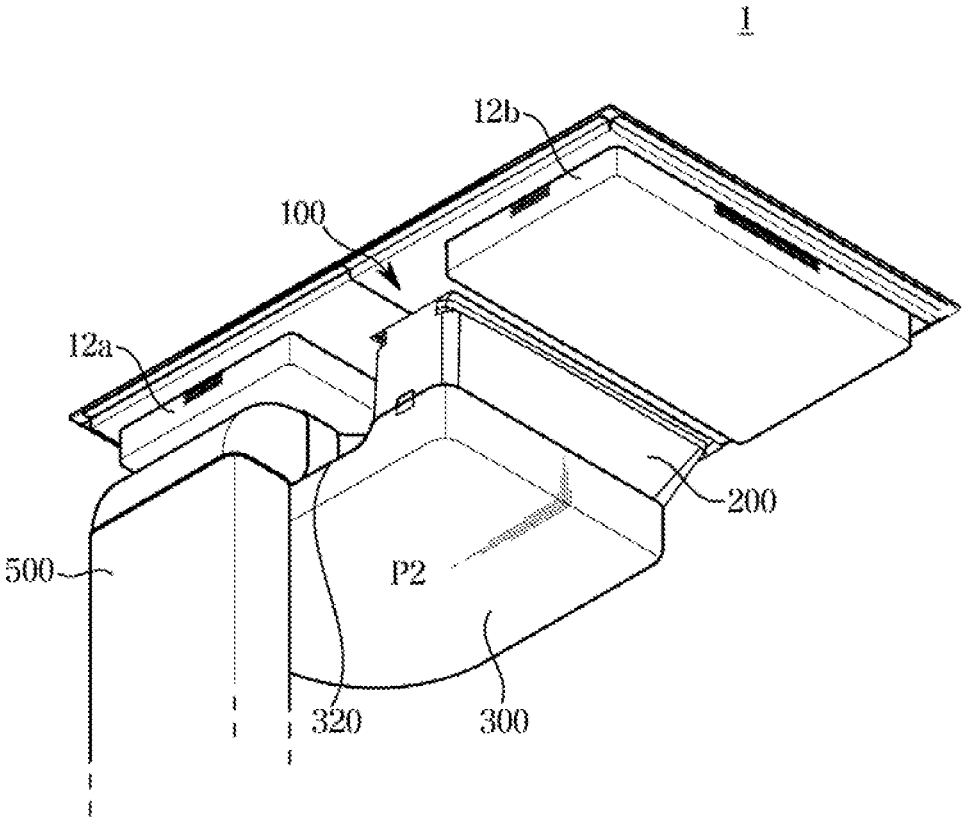
Figure 9:
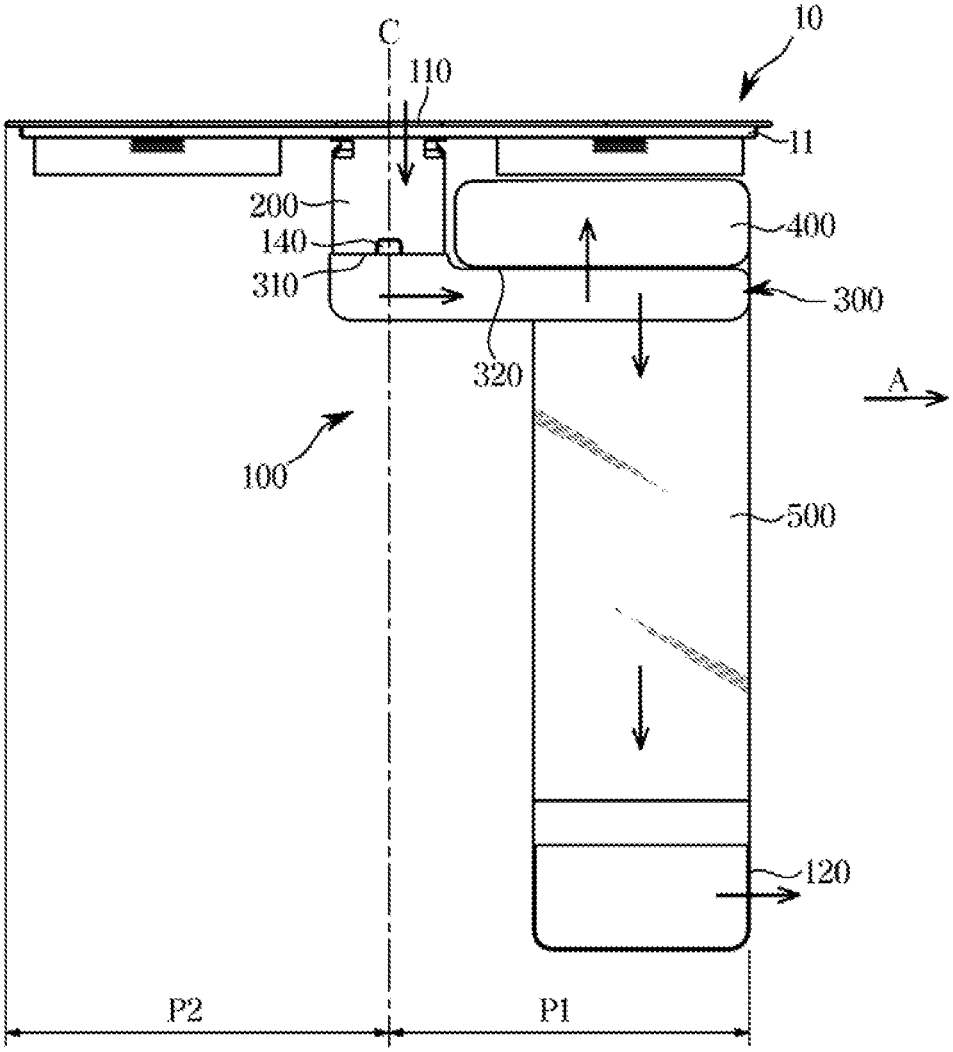
FIGS. 9 and 10 illustrate that the direction of the second pipe is changed left and right in the ventilation apparatus according to an embodiment of the disclosure.
Figure 10:
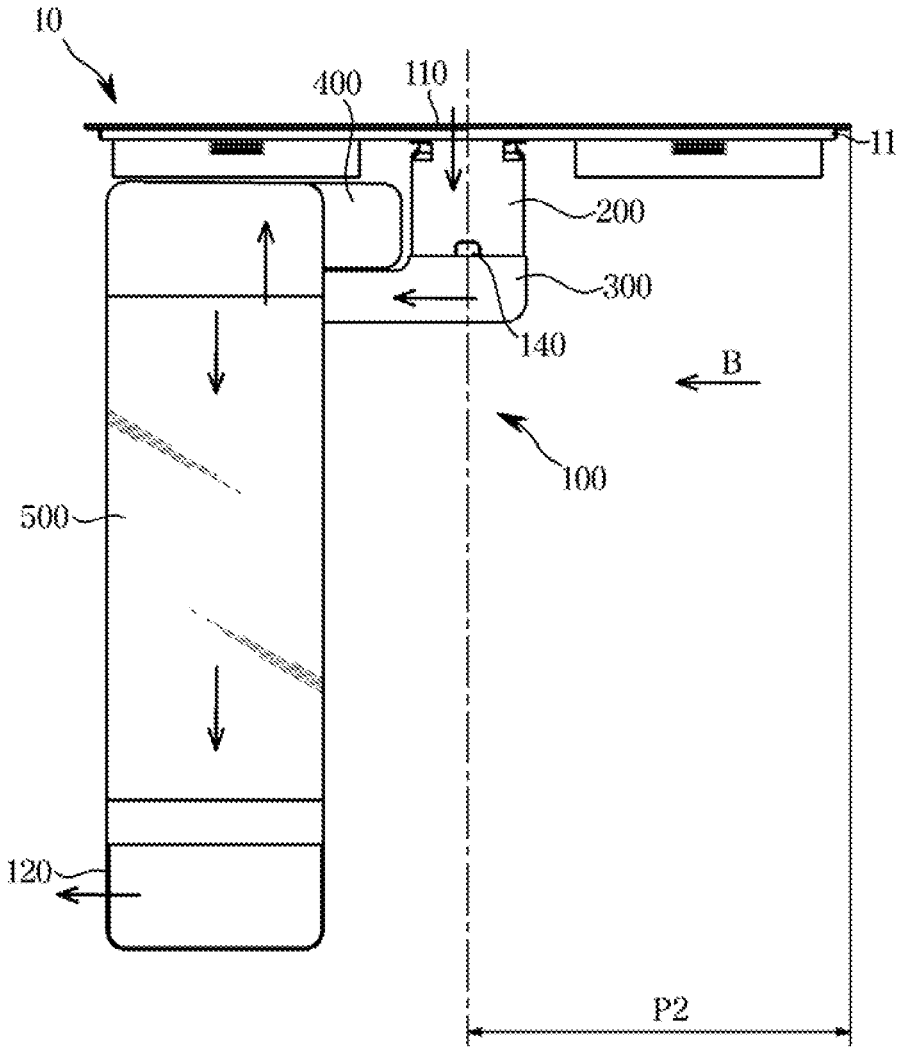
Figure 11A:
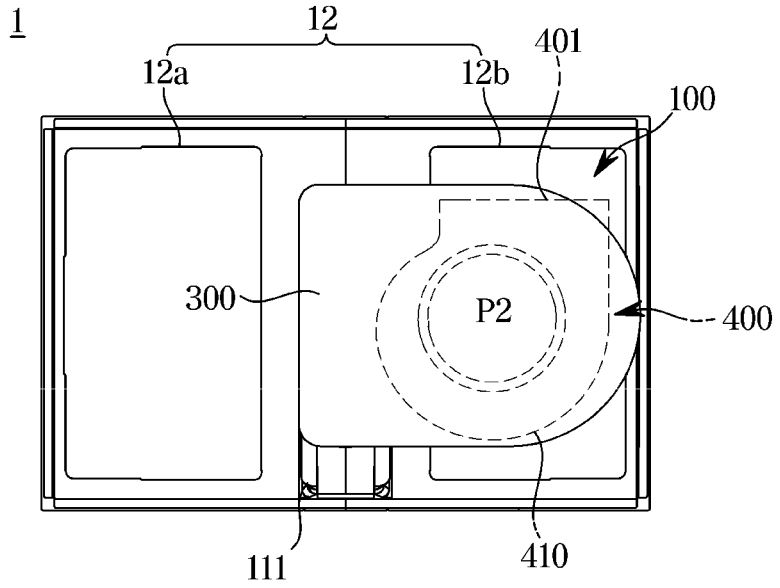
FIGS. 11A, 11B, 11C and 12A, 12B, 12C illustrate that a third pipe is rotated in the ventilation apparatus according to an embodiment of the disclosure.
Figure 11B:
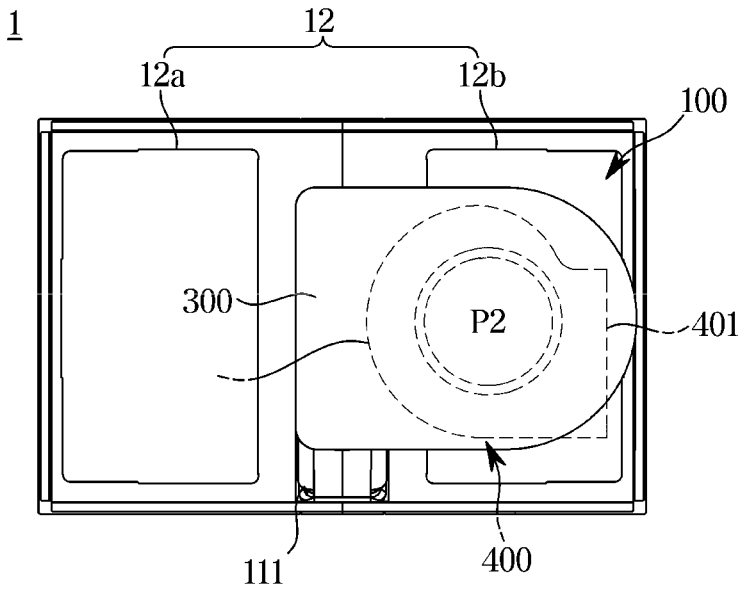
Figure 11C:
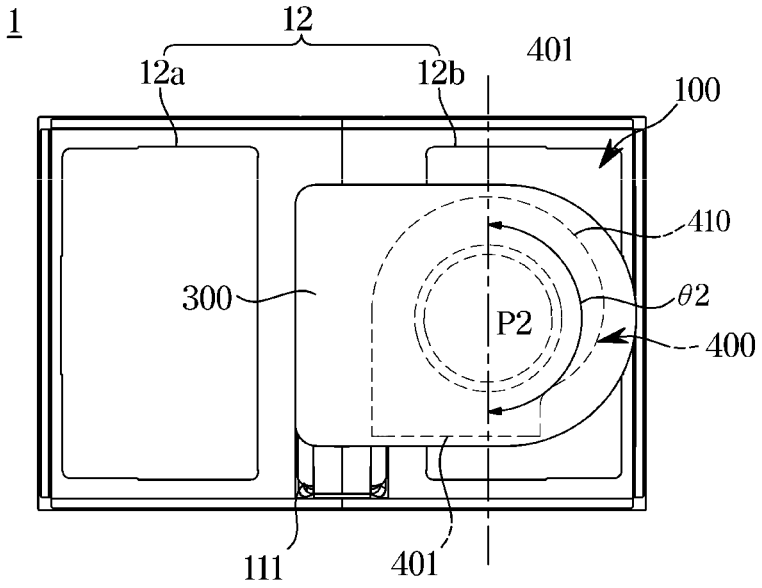
Figure 12A:
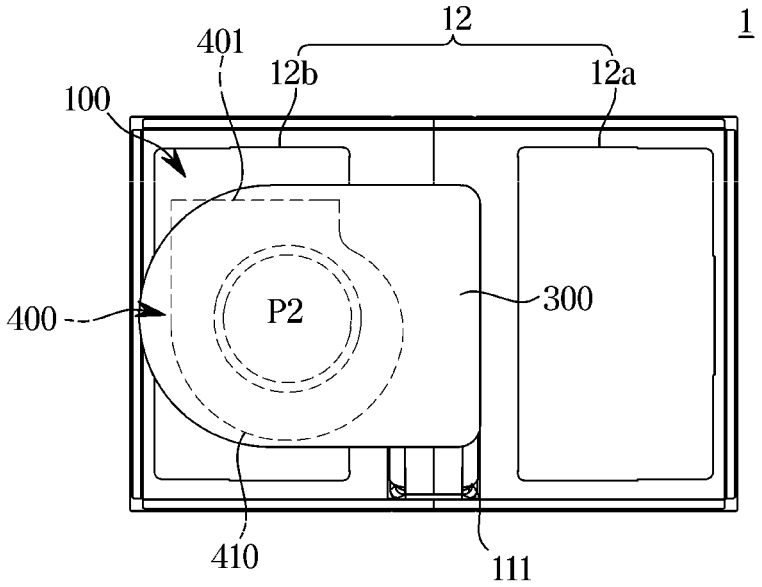
Figure 12B:
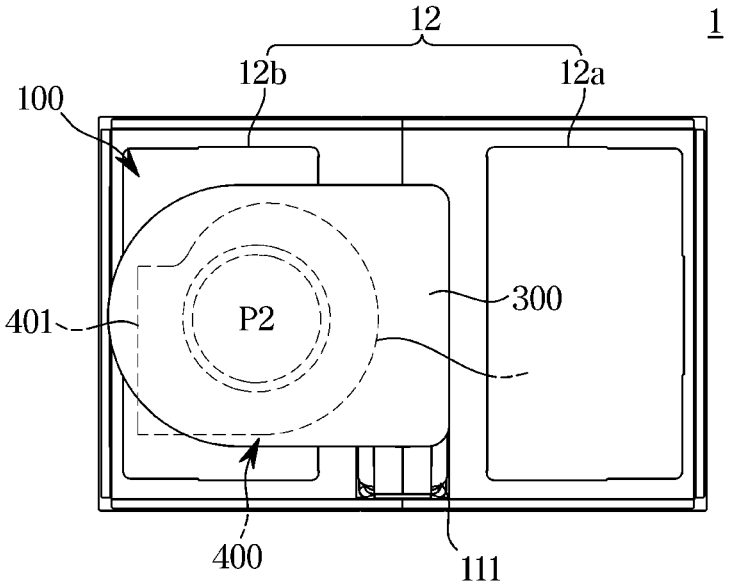
Figure 12C:
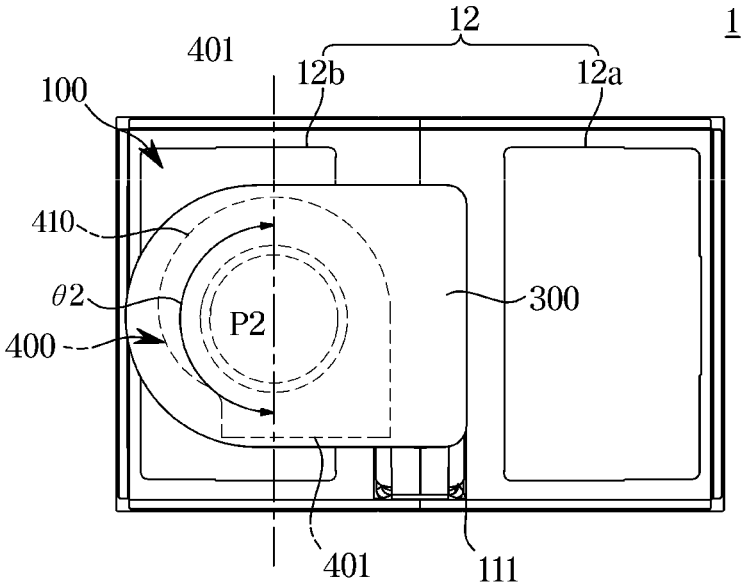

FIG. 5 is an enlarged view of an area Ain FIG. 3, illustrating a state in which the first pipe and the second pipe in the ventilation apparatus according to an embodiment of the disclosure are coupled to each other, FIGS. 6 to 8 illustrate operations of changing a direction of the second pipe with respect to the first pipe in the ventilation apparatus according to an embodiment of the disclosure, FIGS. 9 and 10 illustrate that the direction of the second pipe is changed left and right in the ventilation apparatus according to an embodiment of the disclosure, and FIGS. 11A, 11B, 11C and 12A, 12B, 12C illustrate that a third pipe is rotated in the ventilation apparatus according to an embodiment of the disclosure.

As illustrated in FIGS. 5 to 12, the second pipe 300 of the ventilation apparatus 100 may be detachably connected to the first pipe 200.

The second pipe 300 may be connected to an end of the first pipe 200. The first pipe 200 may be formed to extend from a lower side of the suction port 111. The first pipe 200 is configured to allow contaminated air generated during cooking in the cooking apparatus 10 to be sucked downward through the suction port 111.

The first pipe 200 may include a connection member 140 provided to connect the second pipe 300 in a detachable manner. The connection member 140 may include a first connection member 141 provided in the first pipe 200 and a second connection member 142 provided in the second pipe 300.

The first connection member 141 and the second connection member 142 may be disposed at positions corresponding to each other. The first connection member 141 disposed in the first pipe 200 may include a hook. The second connection member 142 disposed in the second pipe 300 may include a hook groove.

The first connection member 141 may be configured to be movable by pressing of a user. As the coupling with the second connection member 142 is released by the movement of the first connection member 141, the first pipe 200 and the second pipe 300 may be separated.

An embodiment of the disclosure illustrates that the first and second connection members 141 and 142 are a hook and a hook groove, respectively, but the disclosure is not limited thereto. That is, the first and second connection members 141 and 142 may include various structures as long as the first pipe 200 and the second pipe 300 may be connected detachably.

The second pipe 300 may include a coupling portion 310 (first connection portion 310) connected to the first pipe 200, and an extension portion 320 (second connection portion 320) extending from the coupling portion 310 (first connection portion 310) so that the third pipe 400 is rotatably installed.

The extension portion 320 (second connection portion 320) may extend to protrude to one side of the coupling portion 310 (first connection portion 310). The coupling portion 310 (first connection portion 310) may be formed in a shape and size corresponding to the first pipe 200 to be connected to a lower end of the first pipe 200. The coupling portion 310 (first connection portion 310) may be detachably coupled to the first pipe 200 by the connection member 140.

The extension portion 320 (second connection portion 320) may be installed at a first position P1 and a second position P2 of the first pipe 200. The extension portion 320 (second connection portion 320) may be located at the first position P1 on one side of the first pipe 200 or at the second position P2 on the other side of the first pipe 200. The first position P1 and the second position P2 may be symmetrical left and right with respect to a center C of the main body 11.

The second pipe 300 may be disposed at the first position P1 and the second position P2 of the first pipe 200. The second pipe 300 may be configured such that the extension portion 320 (second connection portion 320) is located at the first position P1 of the first pipe 200 or at the second position P2 of the first pipe 200 depending on a coupling direction of the coupling portion 310 (first connection portion 310).

The second pipe 300 may be coupled to the first pipe 200 such that the coupling portion 310 (first connection portion 310) may be changed in direction from the first position P1 to the second position P2 of the first pipe 200 depending on the coupling position and direction of the coupling portion 310 (first connection portion 310).

Specifically, the coupling portion 310 (first connection portion 310) of the second pipe 300 may be located at a lower side of the first pipe 200 and coupled to the connection member 140, and the extension portion 320 (second connection portion 320) of the second pipe 300 may be located at the first position P1. In this case, air introduced through the suction port 111 flows from the center of the cooking apparatus 10 to the first direction A (right side) through the flow passage 102.

Conversely, when the connection member 140 between the second pipe 300 and the first pipe 200 is released and the second pipe 300 is rotated 180 degrees, the coupling portion 310 (first connection) of the second pipe 300 is located at the lower side of the first pipe 200, and the extension portion 320 (second connection portion 320) is located at the second position P2.

When the extension portion 320 (second connection portion 320) of the second pipe 300 is located at the second position P2 of the first pipe 200, air introduced through the suction port 111 flows from the center of the cooking apparatus 10 to the second direction B (left side) through the flow passage 102. The first direction A (right side) and the second direction B (left side) of the second pipe 300 may be changed depending on the position of the discharge hole O for discharging air.

Figure 13:
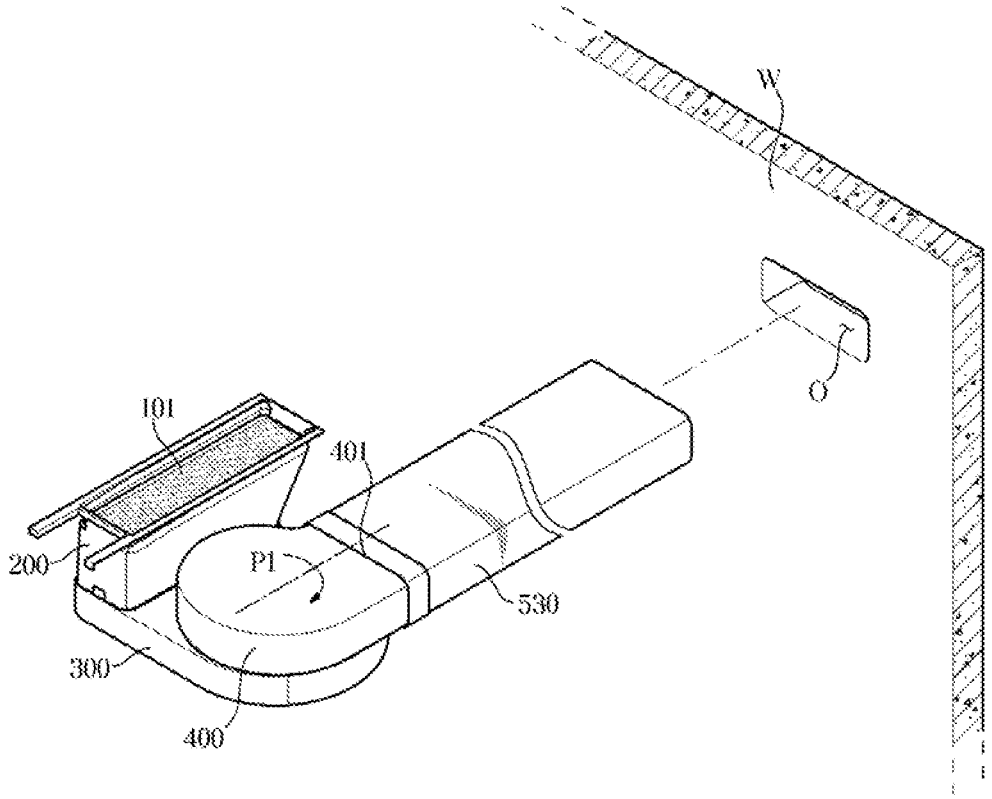
FIGS. 13 and 14 illustrate the pipes of the ventilation apparatus according to an embodiment of the disclosure.
Figure 14:
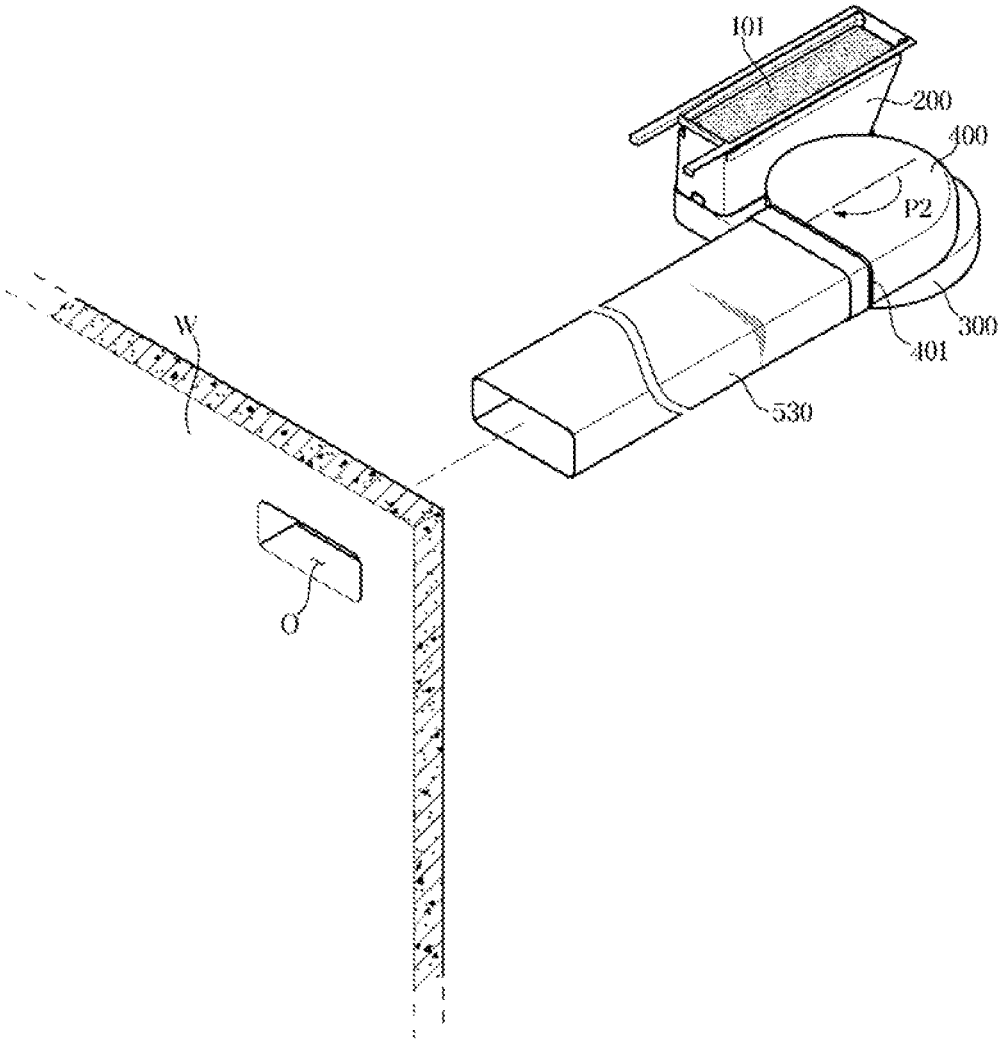

FIGS. 11A, 11B, 11C and 12A, 12B, 12C illustrate that a third pipe is rotated in the ventilation apparatus according to an embodiment of the disclosure, and FIGS. 13 and 14 illustrate the pipes of the ventilation apparatus according to an embodiment of the disclosure.

As illustrated in FIGS. 11A, 11B, 11C and 12A, 12B, 12C, the third pipe 400 of the ventilation apparatus 100 is rotatably connected to the second pipe 300. The third pipe 400 is rotatably connected to the extension portion 320 (second connection portion 320) of the second pipe 300.

The third pipe 400 includes the discharge port 401 to discharge contaminated air.

The third pipe 400 may include a pipe body 410 formed in a circular shape to be rotatably coupled to the extension portion 320 (second connection portion 320) of the second pipe 300, and the discharge port 401 extending from one side of the pipe body 410. The discharge port 401 may be formed by protruding at least a portion of the circular pipe body 410 outward. The discharge port 401 is provided to discharge air introduced into the pipe body 410.

The discharge port 401 of the third pipe 400 is provided such that contaminated air, which is introduced through the suction port 111 and passes through the first pipe 200 and the second pipe 300 in order, and then is introduced into the third pipe 400, may be discharged.

The third pipe 400 may further include a gasket-type reinforcement (not shown) for gas sealing that is rotatably connected to the second pipe 300.

The third pipe 400 is rotatably coupled to the second pipe 300 so that the position of the discharge port 401 to allow contaminated air to be discharged may be changed.

In the first position P1, the third pipe 400 may be rotated within a switching angle of 0 degrees to 180 degrees. In the first position P1, the discharge port 401 of the third pipe 400 may be changed in position within the switching angle of 0 degrees to 180 degrees. In the first position P1, the position of the discharge port 401 of the third pipe 400 may be changed in a range between 0 degrees and 180 degrees by the rotation of the third pipe 400.

In the second position P2, the third pipe 400 may be rotated within a switching angle of 0 degrees to 180 degrees. In the second position P2, the discharge port 401 of the third pipe 400 may be changed in position within the switching angle of 0 degrees to 180 degrees. In the second position P2, the position of the discharge port 401 of the third pipe 400 may be changed in a range between 0 degrees and 180 degrees by the rotation of the third pipe 400.

Accordingly, because discharge of contaminated air through the discharge port 401 of the third pipe 400 is possible in a section from 0 degrees to 180 degrees in the first position P1 or a section from 0 degrees to 180 degrees in the second position P2, air may be discharged from various locations, so that space efficiency may be improved with a compact structure.

Figure 15:
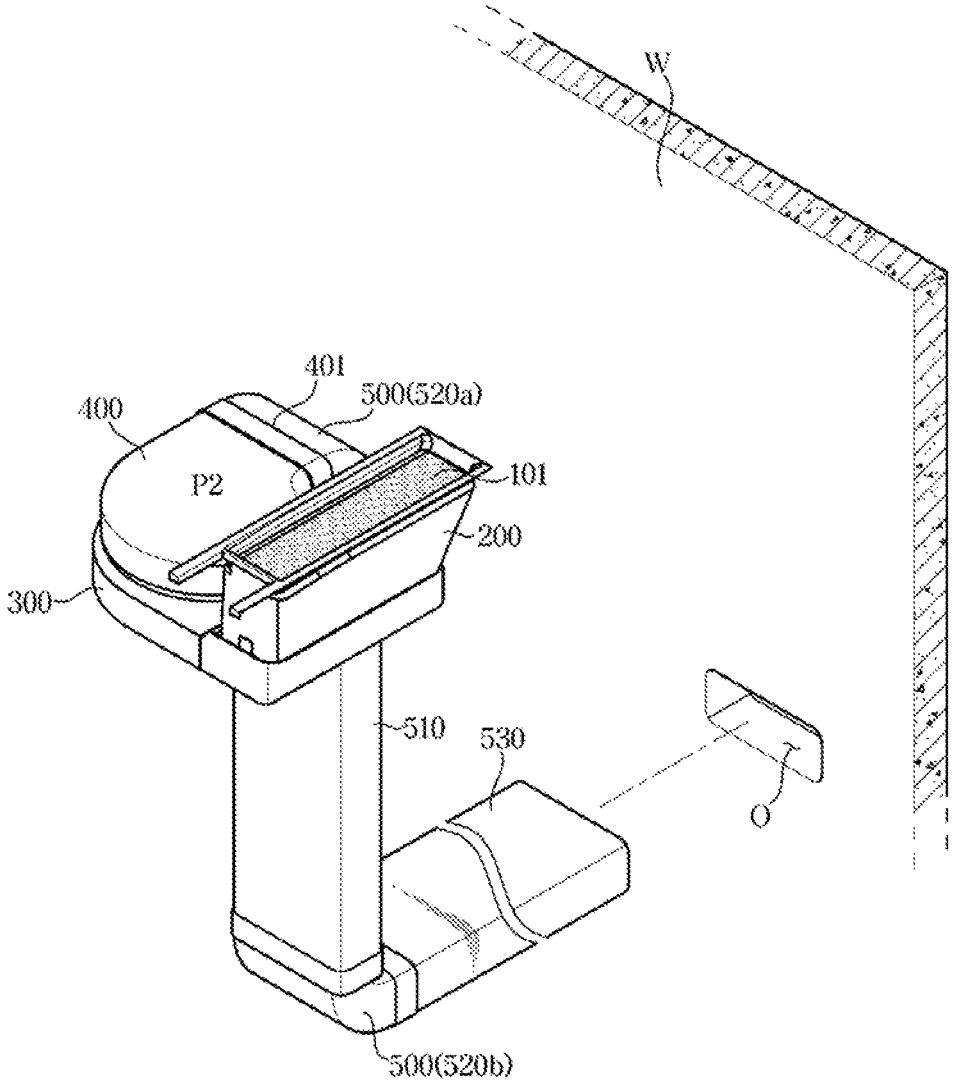
FIGS. 15 and 16 illustrate pipes of a ventilation apparatus according to another embodiment of the disclosure.
Figure 16:
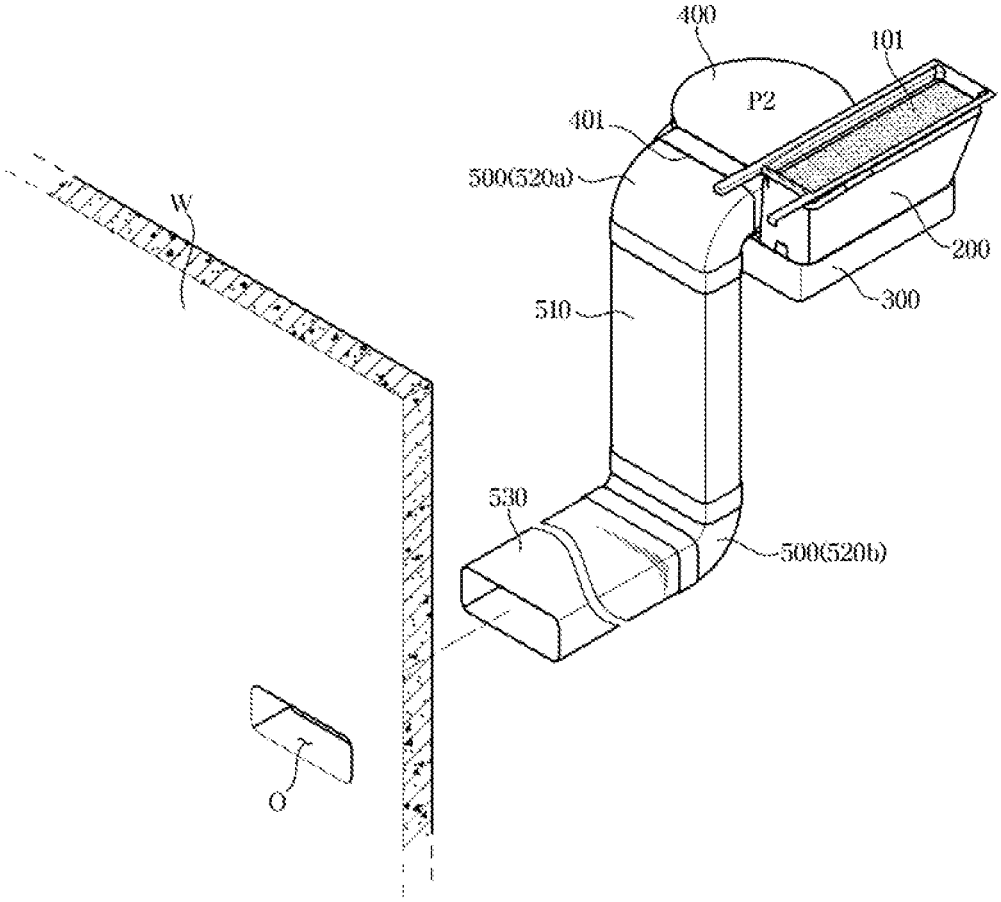

FIGS. 13 and 14 illustrate the pipes of the ventilation apparatus according to an embodiment of the disclosure, and FIGS. 15 and 16 illustrate pipes of a ventilation apparatus according to another embodiment of the disclosure.

As illustrated in FIGS. 13 to 16, the ventilation apparatus 1 may further include the discharge guide pipe 500 connected to the discharge port 401 to discharge contaminated air. One or more of the discharge guide pipes 500 may be connected. The discharge guide pipe 500 may be connected to the third pipe 400.

The discharge guide pipe 500 connected to the discharge port 401 of the third pipe 400 may include the horizontal guide pipe 530 having a linear shape in a horizontal direction. The horizontal guide pipe 530 connected to the discharge port 401 of the third pipe 400 may be provided such that contaminated air moving through the discharge port 401 of the third pipe 400 may be discharged to the discharge hole O positioned at the rear in the horizontal direction. The discharge guide pipe 500 may be connected to the discharge port 401 to discharge air according to the location of the discharge port 401. In this case, the extension portion 320 (second connection portion 320) of the second pipe 300 is placed in the first position P1, the discharge port 401 of the second pipe 300 is placed at a first angle 81, and an end of the horizontal guide pipe 530 may be connected to the discharge hole O.

The discharge hole O may be formed in at least a portion of the wall w and the furniture 2. An embodiment of the disclosure illustrates that the horizontal guide pipe 530 extends horizontally and is connected to the discharge hole O, but the disclosure is not limited thereto. For example, at least one of a bent pipe and an elbow pipe may be further connected to the horizontal guide pipe 530 depending on the position of the discharge hole O.

The discharge port 401 of the third pipe 400 may be positioned to face the front of the main body 11. The discharge port 401 of the third pipe 400 may be rotated at a second angle θ2. When the third pipe 400 is rotated at the second angle θ, that is, 180 degrees from the first position P1, the discharge port 401 of the third pipe 400 may be positioned to face the front of the main body 11.

The discharge guide pipe 500 connected to the discharge port 401 of the third pipe 400 may be the horizontal guide pipe 530 having a linear shape in the horizontal direction. The horizontal guide pipe 530 connected to the discharge port 401 of the third pipe 400 may allow the air moved through the discharge port 401 of the third pipe 400 to be discharged to the front of the main body 11. In this case, the discharge hole O connected to the horizontal guide pipe 530 is positioned in the front of the wall w or the furniture 2.

As illustrated in FIGS. 15 and 16, the ventilation apparatus 100 may be compactly configured to be easily connected to a discharge hole O formed on the wall w or the furniture 2 to discharge contaminated air.

When the discharge hole O is positioned at a lower left rear of the cooking apparatus 10, the extension portion 320 (second connection portion 320) of the second pipe 300 is located in the second position P2, and the discharge port 401 of the third pipe 400 is rotated at the first angle θ1 (0 degrees) to face the rear.

The ventilation apparatus 100 further includes the discharge guide pipe 500 connecting the discharge port 401 of the third pipe 400 and the discharge hole O. The discharge guide pipe 500 connected to the discharge port 401 of the third pipe 400 may include a first bent pipe 520*a* bent from the horizontal direction to the vertical direction, the vertical guide pipe 510 connected to the first bent pipe 520*a*, a second bent pipe 520*b* connected to the vertical guide pipe 510 and bent from the vertical direction to the horizontal direction, and the horizontal guide pipe 530 connected to the second bent pipe 520*b*. The horizontal guide pipe 530 may be connected to the discharge hole O to discharge contaminated air.

When the discharge hole O is positioned at a lower left front of the heating device 12, the extension portion 320 (second connection portion 320) of the second pipe 300 is located in the second position P2, and the discharge port 401 of the third pipe 400 is rotated at the second angle θ2 (180 degrees) to face the front.

The discharge guide pipe 500 is provided to connect the discharge port 401 of the third pipe 400 and the discharge hole O. The discharge guide pipe 500 connected to the discharge port 401 of the third pipe 400 may further include the first bent pipe 520*a* bent from the horizontal direction to the vertical direction, the vertical guide pipe 510 connected to the first bent pipe 520*a*, the second bent pipe 520*b* connected to the vertical guide pipe 510 and bent from the vertical direction to the horizontal direction, and the horizontal guide pipe 530 connected to the second bent pipe 520*b*. The horizontal guide pipe 530 may be connected to the discharge hole O to discharge contaminated air.

The discharge guide pipe 500 connecting the discharge port 401 of the third pipe 400 and the discharge hole O may be formed in a compact combination depending on the distance between and the positions of the discharge port 401 and the discharge hole O.

Figure 17:
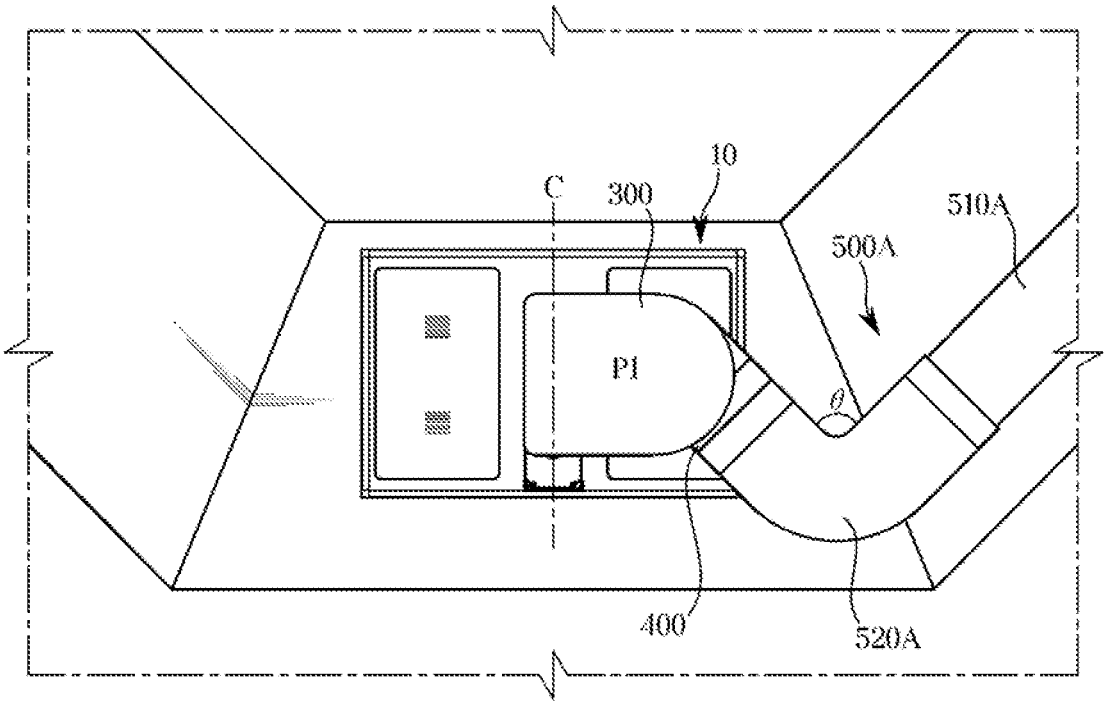
FIGS. 17 and 18 illustrate a discharge guide pipe of the ventilation apparatus according to another embodiment of the disclosure.
Figure 18:
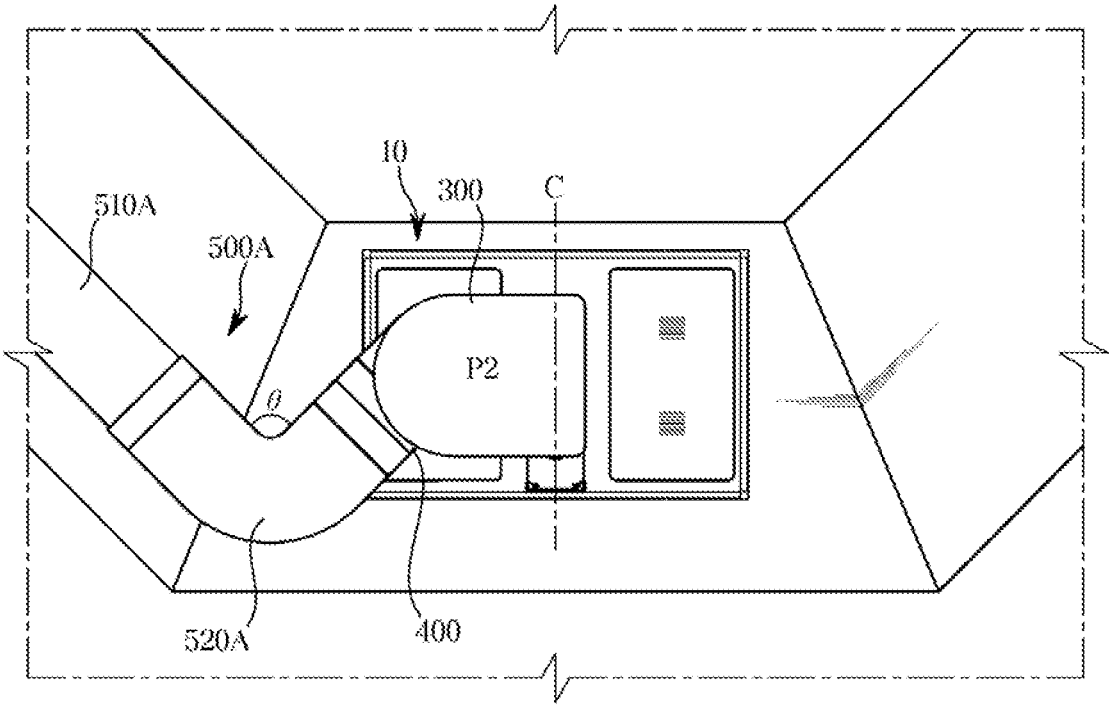

FIGS. 17 and 18 illustrate a discharge guide pipe of the ventilation apparatus according to another embodiment of the disclosure.

As illustrated in FIGS. 17 and 18, the ventilation apparatus 100 of the disclosure may be variously changed depending on an installation space or the shape of the furniture 2.

The second pipe 300 of the ventilation apparatus 100 may be installed such that the discharge port 401 of the third pipe 400 is located in the first position P1 of the first pipe 200. A discharge guide pipe 500A connected to the discharge port 401 of the third pipe 400 may include an elbow pipe 520A having a predetermined angle θ from the horizontal, and a horizontal guide pipe 510A connected to the elbow pipe 520A.

The position of the discharge port 401 may be changed depending on a rotation angle of the third pipe 400. The discharge guide pipe 500A may be changed in various combinations in the first position P1 by being connected to the discharge port 401 of the third pipe 400.

The third pipe 400 of the ventilation apparatus 100 may be configured such that the position of the discharge port 401 may be changed in the second position P2 of the first pipe 200. The discharge guide pipe 500A connected to the discharge port 401 of the third pipe 400 may be combined to be connected to the discharge hole O depending on the position of the discharge port 401. An embodiment of the disclosure illustrates that the discharge guide pipe 500A includes the elbow pipe 520A and the horizontal guide pipe 510A, but the discharge guide pipe 500A may be formed in a compact combination depending on the distance between and the positions of the discharge port 401 and the discharge hole O.

As is apparent from the above, according to an embodiment of the disclosure, a position change of piping in a discharge direction can be freely performed by an improved direction change type hood induction piping structure, so that installation is easy and installation time can be reduced.

In addition, because of a compact piping structure, space utilization and space efficiency can be increased.

While the disclosure has been particularly described with reference to exemplary embodiments, it should be understood by those of skilled in the art that various changes in form and details may be made without departing from the spirit and scope of the disclosure.

What is claimed is:

1. A ventilation apparatus configured to be installed under a surface, the ventilation apparatus comprising:

a first pipe configured to be coupled to a suction port;

a second pipe that, when the ventilation apparatus is installed under the surface, extends in a horizontal direction and has an upper side, the second pipe including a first connection portion on the upper side and that is configured to be coupled to and decoupled from the first pipe, and a second connection portion on the upper side; and a third pipe including a discharge port, the third pipe configured to be rotatably coupled to the second connection portion so as to be rotatable in a horizontal plane to change a position of the discharge port, wherein the first pipe, the second pipe, and the third pipe are thereby configured so that, when the ventilation apparatus is installed under the surface with the first pipe coupled to the suction port, the first connection portion coupled to the first pipe, and the third pipe rotatably coupled to the second connection portion, contaminated air above the surface generated during cooking of food is sucked through the suction port to flow through the first pipe, then through the second pipe, then through the third pipe, and to then be discharged through the discharge port.

2. The ventilation apparatus according to claim 1, further comprising:

a discharge guide pipe configured to be coupled to the discharge port of the third pipe to discharge the contaminated air.

3. The ventilation apparatus according to claim 1, wherein the first connection portion of the second pipe is configured to be coupled to and decoupled from to the first pipe so that a flow direction of the contaminated air through the second pipe is changeable by 180 degrees.

4. The ventilation apparatus according to claim 1, wherein, when the ventilation apparatus is installed under the surface with the first pipe coupled to the suction port, the first connection portion coupled to the first pipe, and the third pipe rotatably coupled to the second connection portion, the second pipe is positioned on one of a left side and a right side of the first pipe.

5. The ventilation apparatus according to claim 1, wherein the first connection portion of the second pipe comprises a connection member configured to allow the first pipe and the second pipe to be coupled to and decoupled from each other.

6. The ventilation apparatus according to claim 1, further comprising:

a suction fan configured to generate a suction force so that the contaminated air is sucked into the suction part.

7. The ventilation apparatus according to claim 6, wherein the suction fan is disposed in at least one of the second pipe and the third pipe.

8. The ventilation apparatus according to claim 6, wherein the third pipe is configured such that air introduced in an axial direction of the suction fan is discharged in a horizontal direction of the discharge port.

9. The ventilation apparatus according to claim 2, wherein the discharge guide pipe includes a horizontal guide pipe, a vertical guide pipe, and at least one of a bent pipe bent from a horizontal direction to a vertical direction, a bent pipe bent from the vertical direction to the horizontal direction, and an elbow pipe having an elbow shape.

10. The ventilation apparatus according to claim 1, further comprising:

at least one filter provided inside the first pipe and configured to purify the contaminated air.

11. A ventilation system comprising:

a main body;

and a ventilation apparatus under an upper surface of the main body, wherein the ventilation apparatus includes:

a first pipe coupled to a suction port in the upper surface, at least one filter inside the first pipe, a second pipe extending in a horizontal direction and having an upper side, the second pipe including a first connection portion on the upper side that is coupled to the first pipe and a second connection portion on the upper side, and a third pipe including a discharge port, the third pipe being rotatably coupled to the second connection portion so as to be rotatable in a horizontal plane to thereby change a position of the discharge port;

wherein the first pipe, the second pipe, and the third pipe are thereby configured so that contaminated air above the upper surface generated during cooking of food is sucked through the suction port to flow through the first pipe, then through the second pipe, then through the third pipe, and to then be discharged through the discharge port.

12. The ventilation system according to claim 11, further comprising:

a discharge guide pipe coupled to the third pipe to discharge the contaminated air.

13. The ventilation system according to claim 12, wherein the discharge guide pipe includes a horizontal guide pipe, a vertical guide pipe, and at least one of a bent pipe bent from a horizontal direction to a vertical direction, a bent pipe bent from the vertical direction to the horizontal direction, and an elbow pipe having an elbow shape.

14. The ventilation system according to claim 11, further comprising:

a suction fan configured to generate a suction force so that the contaminated air is sucked into the suction port.

15. The ventilation system according to claim 14, wherein the suction fan is disposed in at least one of the second pipe and the third pipe.

16. The ventilation system according to claim 11, wherein the second pipe includes a connection member configured to allow the first pipe and the second pipe to be detachably coupled to each other.

17. The ventilation system according to claim 11, wherein the at least one filter includes a grease filter configured to remove oil contained in the contaminated air.

* * * * *